US005341587A

United States Patent [19]

Phillips, Jr.

[11] Patent Number: 5,341,587

[45] Date of Patent: Aug. 30, 1994

[54] EJECTOR AND CARTRIDGE POSITIONER

[75] Inventor: Jonathan W. Phillips, Jr., Hitchcock, Tex.

[73] Assignee: Phillips and Rodgers, Inc., Huntsville, Tex.

[21] Appl. No.: 12,591

[22] Filed: Feb. 3, 1993

[51] Int. Cl.[5] ..... F41A 15/02

[52] U.S. Cl. ..... 42/68

[58] Field of Search ..... 42/68, 89, 62

[56] References Cited

U.S. PATENT DOCUMENTS 4,127,955 12/1978 Curran ..... 42/68
4,318,239 3/1982 Phillips ..... 42/89
4,541,193 9/1985 Flippin ..... 42/68
4,543,741 10/1985 Phillips ..... 42/68
4,720,930 1/1988 Schreiber ..... 42/68
5,218,148 6/1993 Mochak ..... 42/68

*Primary Examiner*—David H. Brown
*Attorney, Agent, or Firm*—Pravel, Hewitt, Kimball & Krieger

[57] ABSTRACT

An extractor and positioner mechanism is provided for revolvers or like weapons. An increased area contact surface is provided for enhancing the positioning and extraction or ejection functions. The mechanism also allows proper seating in the chamber for rimmed and rimless cartridges. Loading of cartridges into chambers in the revolvers is also made easier.

7 Claims, 2 Drawing Sheets

EJECTOR AND CARTRIDGE POSITIONER

BACKGROUND OF INVENTION

1. Field of Invention

The present invention relates to weapons, more particularly to extractor and positioner mechanisms for revolvers and the like.

2. Description of Prior Art

U.S. Pat. No. 4,543,741, of which applicant is the inventor, provided an ejector/extractor mechanism for weapons, such as revolvers, which have multiple bores in a cylinder for receiving cartridges. A mechanism of this type was adapted to permit use of shells of a common caliber but of different lengths.

To a large extent, the mechanism according to this patent permitted these objects to be achieved. The limited area of space available within the interior of the cylinder, however, imposed size limits on the extractor/positioner mechanism. This hindered the operation of the mechanism and also affected its ruggedness and durability. The space available within the cylinder for the extractor/positioner could not safely be increased. Any design which would do so would require a potentially dangerous thinning of the cylinder walls. Another possible problem was that of proper seating of rimmed and semi-rimmed cartridges in the chamber of this prior type of mechanism.

SUMMARY OF INVENTION

Briefly, the present invention provides a new and improved ejector/extractor and positioner for a weapon having a cylinder for receiving cartridges to be fired. The ejector and positioner serves as a casing ejector and positioner for cartridges received in cartridge bores in a cylinder body of the revolver. The ejector/-positioner includes a longitudinally extending extractor rod which is movable along its longitudinal axis relative to a central bore passage of the cylinder body. The ejector/positioner mechanism of the present invention also includes an extractor spring mounted along the extractor rod forward of the cylinder body. An ejector body is mounted about the extractor rod at an intermediate position within the cylinder body.

Ejector arms are formed integrally with the ejector body extending rearwardly from the ejector body toward a rear face of the cylinder body. The ejector arms have a first portion adapted to slidably move within the central passage bore and an outwardly sloping second portion. The second portion of the ejector arms fits along a corresponding sloping outwardly tapered rest surface. The tapered rest surface is formed in a rear portion of the cylinder body between the central bore and cartridge bore. The ejector arms also include cartridge engaging lips, formed on the second portion, which are movable within radially extending recesses formed in the rear portion of the cartridge cylinder between the central bore and the cartridge bore.

DESCRIPTION OF THE PREFERRED EMBODIMENT

Figure 1:
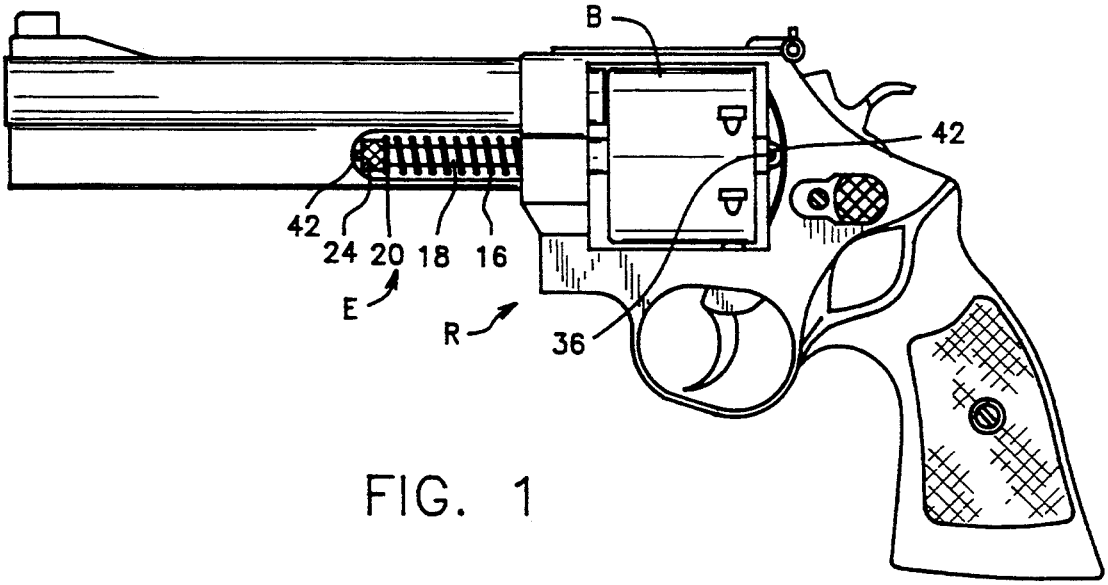
FIG. 1 is an elevation view of a revolver having a casing ejector/cartridge positioner according to the present invention.

In the drawings, a casing ejector/cartridge positioner mechanism M according to the present invention is shown. The mechanism M is adapted for a revolver R having a revolver cylinder body B with a suitable number of cartridge bores 10 to receive cartridges for firing. As will be set forth below, the mechanism M of the present invention allows the revolver R to fire cartridges of slightly different caliber safely and effectively.

Figure 2:
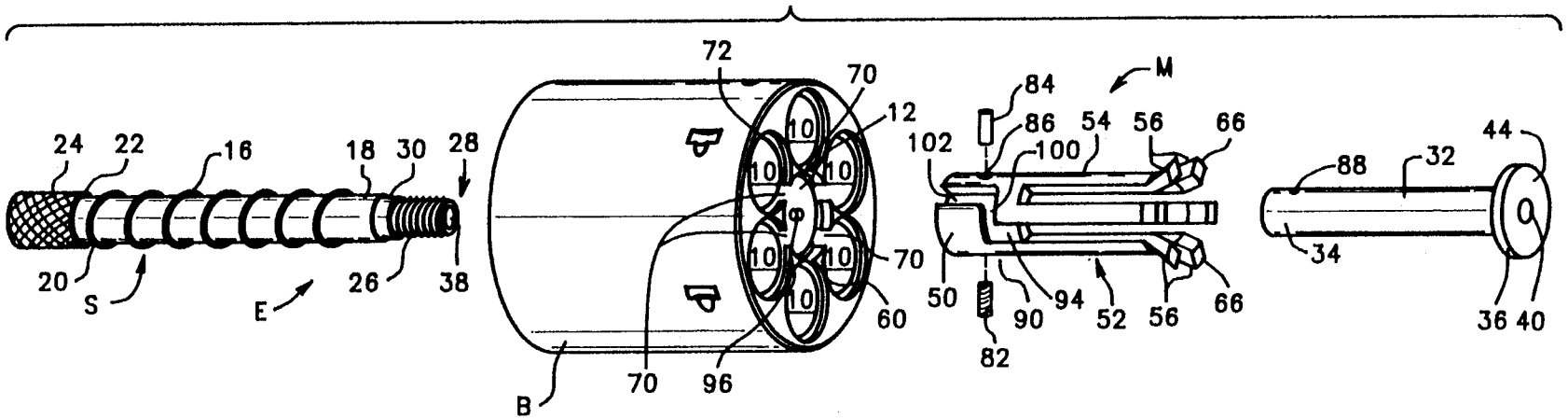
FIG. 2 is an exploded isometric view of a casing ejector/cartridge positioner according to the present invention.
Figure 5:
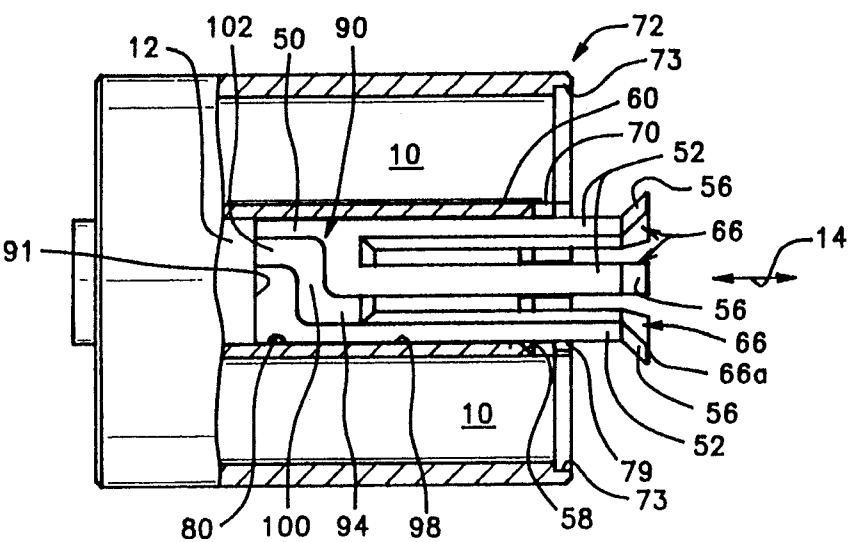
FIG. 5 is an elevation view, taken partly in cross-section, of a portion of the structure of FIG. 2.

The mechanism M includes an extractor rod E mounted within a central bore passage 12 of the revolver cylinder body B. The extractor rod E is movable along its longitudinal axis indicated by an arrow 14 (FIGS. 3 and 5) relative to the central bore passage 12 of the revolver cylinder body B. An extractor spring S, preferably in the form of an elongate cylindrical helical spring 16, is mounted along a front portion 18 of the extractor rod E forward of the cylinder body B. The spring 16 is mounted at its front end 20 in an annular groove or recess 22 (FIG. 2) formed in the front portion 18 behind a knurled grip or knob 24 on the extractor rod E.

The front portion 18 of the extractor rod E includes a threaded connector surface 26 (FIG. 2) at an end 28 opposite the knob 24. The threaded connector surface 26 extends outwardly from a reduced diameter collar portion 30 of the front portion 18 of the extractor rod E. The collar 30 and the connector surface 26 of the front portion 18 are received within matching, correspondingly sized threaded inner connector surface **26*a* (FIG. 3) and collar portion 30*a* of a rear portion or segment 32 of the extractor rod E. The front portion 18 and rear portion 32 of the extractor rod E are thus threadedly interconnected at an inner portion 34 along the length of the extractor rod E. In this manner, the extractor rod E forms a generally elongate, uniform diameter rod between the recess 22 rearwardly of the knob 24 and rear stop or rim portion 36 at an opposite end of the rear portion 32**.

The front portion 18 of the extractor E has a hollow central portion or passage 38 (FIG. 2) formed extending along its length, while the rear portion 30 of the extractor rod E also has a correspondingly aligned central portion or passage 40 along its length so that a conventional pivot pin 42 (FIG. 1) may be mounted and installed therein. The pivot pin 42 when installed extends beyond the knob 24 at the front end of the extractor rod E and beyond the rear stop 36 at its rear end mount the revolver cylinder body B and the mechanism M within the revolver R. As is conventional, a suitable ratchet mechanism is mounted on and held in place on a rear surface 44 of the rear stop 36 to allow advancing or rotation of the revolver cylinder body B. This is done to present successive cartridge bores 10 to be aligned with the firing pin of the hammer mechanism of the revolver R so that cartridges in the cartridge bores 10 may be fired.

The mechanism M also includes an ejector body 50 (FIG. 2) mounted about the extractor rod E at its intermediate portion 34. The ejector body 50 is a generally cylindrical member enclosing the intermediate portion 34 of the extractor rod E and having ejector arms 52 extending rearwardly toward a rear face 53 of the revolver cylinder body B. The ejector arms 52 are integrally formed with the ejector body 50 as a unitary body for strength and durability. The ejector arms 52 correspond in number to the number of cartridge bores 10 in the revolver cylinder body B.

The ejector arms have a first portion 54 corresponding in outer diameter to the ejector body 50 and adapted to slidably move within the central passage bore 12 of the revolver cylinder body B. Each of the ejector arms 52 also includes an outwardly sloping second portion 56 fitting along a correspondingly outwardly tapered rest surface 58 formed in a rear portion 60 of the revolver cylinder body B between the central bore passage 12 and each of the cartridge bores 10.

A cartridge engaging lip 66 is formed on the second portion 56 of each of the ejector arms 52. The cartridge engaging lip 66 and the ejector arms 52 are movable because of the resilient nature of the ejector arms 52 within a radially extending recess 70 formed above the rest surface 58. The recess 70 is located in a rear portion 72 of the revolver cylinder body B between the central bore 12 and each of the cartridge bores 10.

The rear portion 72 (FIG. 5) of the revolver cylinder body B has recessed bores 73 formed at the rear of each of the cartridge bores 10. The recessed bores 73 serves as seats so that rims 75 (FIG. 3) of cartridges 76 of the types which have rims may be properly seated. The lip 66 of ejector arm 52 fits into the conventional extraction groove **75*a* in front of the rim 75 of the cartridge 76. For a rimless cartridge 77, the lips 66 of ejector arm 52 fits into an extraction groove 77*a* near the rear portion of the cartridge. The lips 66 preferably have a chamfered edge as shown at 66*a* for ease of fitting and engagement. A centrally located recess bore 79 is formed in the rear portion 72 of the revolver cylinder body B about the central bore passage 12 to serve as a seat for the rear stop 36** of the ejector rod E.

The ejector body 50 has a first mounting passage 80 (FIG. 5) formed extending therethrough for passage of a set screw 82 (FIG. 2) therethrough to initially mount the ejector body 50 onto the extractor rod E in a position of general alignment of the ejector arms 52 with respect to the cartridge bores 10 of the revolver cylinder body B. The ejector body 50 may thereafter be more precisely aligned with respect to the revolver cylinder body B according to the desired amount of movement of the firing mechanism.

When such precise alignment is achieved, a mounting pin 84 is forced through a second mounting passage 86 in the ejector body 50 into a port or socket 88 formed in the rear portion 32 of the extractor rod E. Once fixed, precise alignment is achieved, any portion of the mounting pin 84 extending beyond the outer surface of the ejector body 50 is then milled away to preserve the generally smooth external surface thereon.

Figure 7:
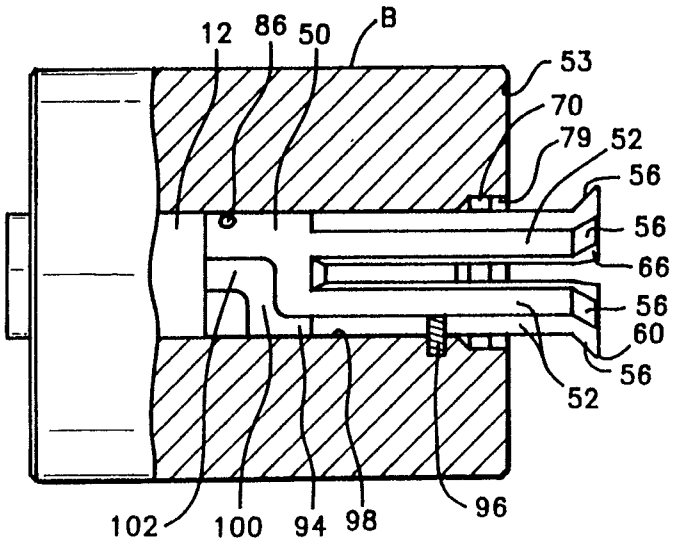
FIG. 7 is an elevation view, taken partly in cross-section, of a portion of the structure of FIG. 2.

A guide slot 90 (FIG. 5) is formed in the ejector body 50 extending from a front surface 91 of the ejector body 50 along a first guide portion 94 extending in the direction of the longitudinal axis 14 of the cylinder body B. The guide slot 90 is adapted to receive a pin 96 (FIG. 7) mounted extending inwardly from an inner surface 98 of the central bore passage 12 of the revolver cylinder body B. The pin 96 is adapted to slide through and move along the guide slot 90 along the first guide portion 94 extending in the direction of the longitudinal axis 14 of the revolver cylinder body B. The guide slot 90 also includes a stop portion 100 extending transversely to the first guide portion 94 to limit movement of the ejector body 50 in the revolver cylinder body B. The guide slot 90 further has a front release portion 102 extending, as was the case with the first guide portion 94, in the direction of the longitudinal axis 14. The pin 96 and guide slot 90 permit the mechanism M to be moved into and out of the revolver cylinder body B through a sequence of sliding, rotation and sliding movement. This is done to permit both installation and removal of the ejector body 50 and the extractor rod E from the revolver cylinder body B. The front surface 91 of the ejector body 50 is adapted to fit against a shoulder 104 formed along the central bore 12 within the revolver cylinder body 8. The front surface 91 of the ejector body 50 also serves as a rear contact surface for the spring 16.

Figure 3:
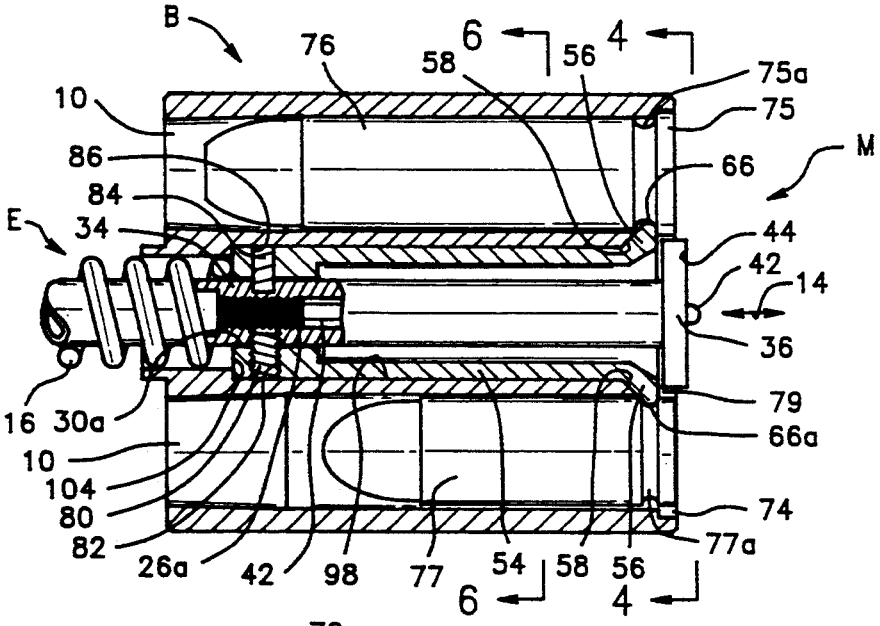
FIG. 3 is an elevation view, taken partly in cross-section, of a cylinder of the revolver of FIG. 1 and the ejector/positioner of FIG. 2.
Figure 4:
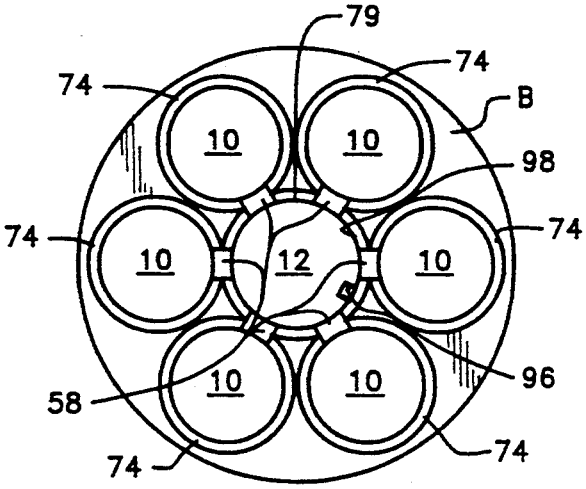
FIG. 4 is a view taken along the lines 4—4 of FIG. 3.
Figure 6:
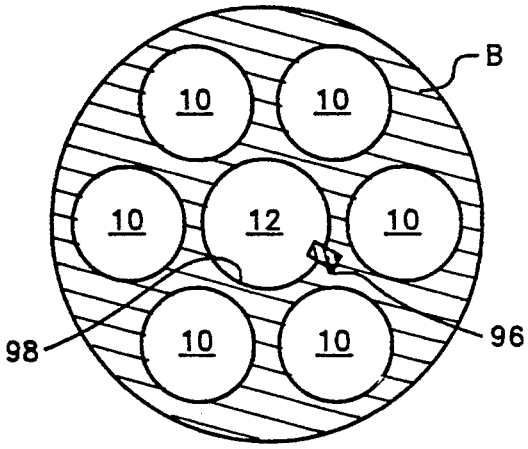
FIG. 6 is a cross-sectional view taken along the line 6—6 of FIG. 3.

In the operation of the present invention, the mechanism M is first assembled by fitting the spring 16 ejector body 50 onto the extractor rod E with the pivot pin 42 in place. The assembled mechanism M is then fitted into the revolver cylinder body B. The cylinder body B and mechanism M are then fitted into the revolver R. The cartridge bores 10 are then loaded with cartridges. Cartridges are inserted into the vacant cartridge bores 10. As the cartridges are inserted, the lips 66 of the ejector arms 52 are engaged. The ejector arms 52 due to their resiliency yield slightly outwardly permitting the cartridges to enter the cartridge bores 10. The entering cartridge slides into the bores 10 until the lip 66 snaps into the extraction groove at the rear of the cartridge, regardless of whether the cartridge is a rimmed one, such as at 76 or a rimless one, such as at 77. Once the cartridges are so positioned, they are gripped firmly in place by the ejector arms 52 of the mechanism M. It is to be noted the individual cartridges need not be of the same type. As shown in FIG. 3, a rimmed cartridge 76 and a rimless or automatic cartridge 77 may be loaded into different cartridge bores in the same load. Further, cartridges of slightly different caliber are held in place by the mechanism M for firing. For example, the mechanism M can permit cartridges of 9 millimeter, 38 caliber, and 357 magnum to be fired from the same revolver in one load.

When it is necessary to reload the revolver R, after the cylinder body B is rotated from its normal firing position within the revolver R, and ejector rod E is moved rearwardly. The lips 66 of the ejector arms 52 assist in urging the spent cartridge casings from the cylinder body B.

Having described the invention above, various modifications of the techniques, procedures, material and equipment will be apparent to those in the art. It is intended that all such variations within the scope and spirit of the appended claims be embraced thereby.

I claim:

1. A casing ejector/cartridge positioner mechanism adapted for revolvers having a revolver cylinder body with cartridge bores, comprising a longitudinally extending extractor rod which is movable along its longitudinal axis relative to a central bore passage of the cylinder body, said extractor rod having an aligned central passage along its length and a pivot pin mounted in said passage to mount said casing ejector mechanism and the revolver cylinder body within a revolver, and including an extractor spring mounted extending from a forward end along said extractor rod forward of the cylinder body, an ejector body mounted about and enclosing said extractor rod at an intermediate position within the cylinder body and having a front surface contacting a rear end of said extractor spring ejector arms integral with said ejector body formed extending rearwardly from said ejector body toward a rear face of the cylinder body, said ejector arms having a first portion adapted to slidably move within said central passage bore and an outwardly sloping second portion fitting along a corresponding outwardly tapered rest surface formed in a rear portion of the cylinder body between the central bore and a cartridge bore, a cartridge engaging lip formed on said second portion and movable within a radially extending recess formed in said rear portion of said revolver cylinder body between said central bore and the cartridge bore.

2. The casing ejector of claim 1, wherein said ejector body has a mounting passage formed therein and further including means in said mounting passage for mounting said ejector body on said extractor rod.

3. The casing ejector of claim 1, wherein said second portion of said ejector body has a uniform slope along its extent.

4. The casing ejector of claim 1, wherein said cartridge engaging lip has a chamfered surface formed along an outer portion thereof to fit within an extraction groove of a cartridge in the cartridge bore.

5. The casing ejector of claim 1, wherein said extractor rod has a recess formed along a forward portion thereof for receiving an end of said retractor spring therein.

6. The casing ejector of claim 1, further including a rear stop mechanism formed on a rear portion of said extractor rod behind the cylinder body.

7. The casing ejector of claim 6, wherein said pivot pin extends beyond a front end of said extractor rod and beyond said rear stop mechanism to mount said casing ejector mechanism and the revolver cylinder body within a revolver.

* * * * *